United States Patent [19]

Leonhard et al.

[11] Patent Number: 4,858,431

[45] Date of Patent: Aug. 22, 1989

[54] APPARATUS FOR REMOVING SOLID PARTICLES, ESPECIALLY SOOT PARTICLES, FROM THE EXHAUST GAS OF AN INTERNAL COMBUSTION ENGINE

[75] Inventors: Rolf Leonhard, Schwieberdingen; Ulrich Projahn, Ditzingen, both of Fed. Rep. of Germany

[73] Assignee: Robert Bosch GmbH, Stuttgart, Fed. Rep. of Germany

[21] Appl. No.: 254,898

[22] Filed: Oct. 7, 1988

[30] Foreign Application Priority Data

Oct. 9, 1987 [DE] Fed. Rep. of Germany ..... 3734197

[51] Int. Cl.[4] ..... F01N 3/02

[52] U.S. Cl. ..... 60/297; 55/466; 55/DIG. 30; 60/303; 60/311

[58] Field of Search ..... 60/297, 303, 311; 55/DIG. 30, 466

[56] References Cited

U.S. PATENT DOCUMENTS

| | | | |
|---|---|---|---|
| 4,345,431 | 8/1982 | Suzuki et al. . | |
| 4,450,682 | 5/1984 | Sato et al. . | |
| 4,649,703 | 3/1987 | Dettling | 60/275 |
| 4,693,078 | 9/1987 | Dettling | 60/295 |

FOREIGN PATENT DOCUMENTS

| | | | |
|---|---|---|---|
| 3121274 | 12/1982 | Fed. Rep. of Germany . | |
| 3424196 | 8/1985 | Fed. Rep. of Germany . | |
| 3526074 | 1/1987 | Fed. Rep. of Germany . | |
| 3532778 | 3/1987 | Fed. Rep. of Germany . | |
| 53620 | 3/1983 | Japan | 60/311 |

OTHER PUBLICATIONS

Japan—Abstract 56-12045 A.

*Primary Examiner*—Douglas Hart
*Attorney, Agent, or Firm*—Edwin E. Greigg

[57] ABSTRACT

An apparatus for removing solid particles, especially soot particles, from the exhaust gases of an internal combustion engine includes a separator that divides the flow of exhaust gases into a largely particle-free primary flow and a particle-enriched secondary flow. The secondary flow is delivered to a disposal device, which has a combustion chamber and a pilot burner for producing a flame that burns off the solid particles. To improve the efficiency of the apparatus by reducing the heating output required, a filter is provided in the combustion chamber, which divides the combustion chamber into a filter pre-chamber and after-chamber. The burnoff flame of the pilot burner burns into the filter pre-chamber, and the burnoff gases are removed via an outlet opening disposed in the filter after-chamber. The secondary exhaust gas flow is delivered to the filter pre-chamber with a tangential inflow direction.

23 Claims, 4 Drawing Sheets

APPARATUS FOR REMOVING SOLID PARTICLES, ESPECIALLY SOOT PARTICLES, FROM THE EXHAUST GAS OF AN INTERNAL COMBUSTION ENGINE

BACKGROUND OF THE INVENTION

The invention relates to an apparatus for removing solid particles, especially soot particles, from the exhaust gas of an internal combustion engine, in particular a Diesel engine. The apparatus has a separator and a disposal device. The separator divides the flow of exhaust gas into a largely particle-free primary flow and a particle-enriched secondary flow, which exit via separate outlets. The disposal device, in turn, has a combustion chamber with an inlet opening connected to the outlet for the secondary flow of exhaust gas, a pilot burner in the combustion chamber produces a burnoff flame that burns off the solid particles, and an outlet opening for removing the gaseous products of the burnoff.

In an apparatus of this kind, also known as an exhaust scrubber, known from German Offenlegungsschrift No. 35 26 074, the separator comprises an agglomerator, also known as an electric filter tube or an electrostatic soot shunt, and a centrifugal filter or cyclone downstream of the agglomerator in the flow of exhaust gases.

In the agglomerator, there is an electrical high-voltage field, in which the solid particles become electrically charged, which causes them to coagulate into relatively large clumps, which because of their relatively great weight are readily removed from the exhaust gas flow mechanically. The mechanical filtering takes place in the centrifugal filter or cyclone, to which the exhaust gases containing the clumps is delivered at a relatively high tangential flow velocity. A rotational flow is brought about in the centrifugal filter, causing the heavy clumps to strike the outer walls and move spirally downward, from whence they are delivered to the disposal device, along with a small portion of the exhaust gas flow, forming a carrier flow, in the form of a particle enriched secondary exhaust gas flow. As the core flow, the majority of the exhaust gas flow, which is largely free of particles, leaves the centrifugal filter centrally and is delivered to the engine exhaust system as the primary exhaust gas flow. The secondary exhaust gas flow, which is heavily laden with soot and other solid clumps, amounts to approximately 1% of the largely particle-free primary exhaust gas flow.

In the known apparatus, the disposal device is designed as a combustion device and comprises a combustion chamber and a pilot burner. The inlet fitting for the secondary exhaust gas flow, embodied as a plunger tube, discharges freely into the interior of the combustion chamber, directly upstream of an overflow opening in a chamber wall dividing the pilot burner from the actual combustion chamber. Via the overflow opening, burning fuel-air mixture from the pilot burner is introduced into the combustion chamber. When the disposal device is started up, a glow element ignites the fuel-air mixture electrically, after which the flame continues to burn automatically during the controlled delivery of fuel-air mixture. The flame surrounds the end of the plunger tube and burns in the combustion chamber, along with the solid particles introduced via the plunger tube. The products of combustion of the solid particles and the other residual gases, which together can be called a gaseous burnoff product, are removed coaxially with the plunger tube via the outlet opening.

Test have shown that under unsteady engine operation conditions, which are particularly typical in engines used to drive motor vehicles, only moderate efficiency is possible with this kind of disposal device having so-called direct soot combustion. This can be ascribed particularly to the short dwell time of the soot or other solid particles in the combustion chamber. Moreover, the short dwell time dictates a very high burnoff temperature of approximately 1000° C., which makes the pilot burner and combustion chamber expensive because of the materials required. Since the disposal device has no provision for storage of the entering solid particles, which instead are combusted directly, the disposal device must be continuously on, during the entire time the engine is in operation, so the required fuel consumption is not inconsiderable. In engines of varying power, the disposal device must be adapted to the individual engine, so that the combustion chamber temperature required for optimal soot combustion can be adhered to. Because of the varying exhaust gas quantities and temperatures, the engineering work involved makes this adaptation expensive.

In another known apparatus for removing solid particles from engine exhaust gas (German Offenlegungsschrift No. 31 21 274), the entire flow of exhaust gas is directed through a filter built into the engine exhaust system. The filter retains only the larger solid particles, however, which makes the disposal device relatively disadvantageous. In a combustion chamber provided on the inlet side of the filter, a pilot burner produces a flame acting upon the surface of the filter. The disposal device is operated intermittently and is turned on only once the filter has become soiled to a predetermined extent. Although compared with the first disposal device described above, the intermittent operation would mean relatively high fuel economy, it still requires bringing the entire flow of exhaust gas to the required burnoff temperature, rather than only the extremely small secondary exhaust gas flow. The burner power required is substantially greater, which not only makes the fuel consumption at least as high as with the other device described, but also requires large pilot burners. A filter disposed in the exhaust gas flow is also at a relatively high risk of filter destruction if the filter becomes overly heavily soiled, for instance from temporary failure of the burner or from increased soot in the exhaust gas, and the filter material is overheated by the ensuing high rate of soot decomposition in the burnoff process. Nor should the danger that the filter will become plugged by incombustible solid particles, which rather severely limits the service life of the filter, be underestimated.

In another known exhaust scrubber (German Offenlegungsschrift No. 34 24 196), the particle-enriched secondary exhaust gas flow is again delivered to a disposal device, in which the combustible solid particles are burned completely. The disposal device has a combustion chamber, into which the secondary exhaust gas flow is introduced axially. The combustion chamber is provided with an electric heating element through which the secondary exhaust gas flows with an admixture of air. Downstream of the heating element is a filter that traps only the incombustible solid particles contained in the gaseous combustion products. The heating element is electrically heated permanently during the entire period of engine operation. Such electric heating has the disadvantage of requiring the handling of high currents, as high as 83 A for 1000 W of heating output in a 12 V system. Electric heating is accordingly suitable only for relatively small exhaust gas scrubbers, and then the engine needs a much larger generator.

OBJECT AND SUMMARY OF THE INVENTION

The efficiency of the apparatus according to the invention for removing solid particles from engine exhaust gas is substantially improved over that of the prior art. By dividing the exhaust gas flow into a primary flow scrubbed of particles and a secondary flow enriched with particles, and by disposing a filter for the secondary flow in the combustion chamber provided with a pilot burner, only a small filter is needed, and moreover only little heating power is required to heat the burner. The filter surface area is only about one-tenth to one-fourth that of a filter disposed in the full exhaust gas flow. By its storage action, the filter also considerably prolongs the dwell time of the solid particles in the combustion chamber, so that they can be burned at a substantially lower burnoff temperature, of approximately 550° C., which can be lowered by a further 200° C. if the filter is coated with a catalyst. The storage action of the filter also enables intermittent burner operation, which substantially lowers the fuel consumption. In the device according to the invention, the total burner output per 100 kW of engine power is approximately 1 to 2 kW.

The efficiency of disposal can be determined by the selection of the filter material and is on the order of 90%. Because of the lower burnoff temperature, the filter material is subjected to substantially lower loads. The same applies to the burner materials, so that the service life of the burner and filter components, measured by the odometer reading for the miles travelled during operation of the engine, can be increased substantially.

Since the filter is exposed to the secondary exhaust gas flow which contains only relatively large solid clumps, because of the aforementioned coagulation, the filter can be of a large-pore type, so that there is little risk that the filter will become plugged with incombustible solid particles. The substantially lower exhaust gas throughput, resulting from the fact that the secondary flow of exhaust gas is very much smaller than the primary flow, contributes further to reducing the danger of plugging. If the filter nevertheless does become plugged, engine operation is unimpaired, even if soot disposal is no longer provided, because the secondary flow is blocked.

The tangential flow of the secondary exhaust gas flow into the filter pre-chamber, as provided in a feature of the invention, produces a certain cyclone effect; as a result, large and hence heavy clumps are already trapped and burned in the filter pre-chamber and do not get into the filter channels, thus further reducing the danger that the filter will become plugged or clogged.

The danger of plugging is especially low in filters embodied as ceramic monoliths with a vertical flow direction, as provided in another feature of the invention, because the incombustible ingredients, such as ash and rust, collect in the filter pre-chamber. Such incombustible ingredients detach and drop out of the filter, a process which vehicle vibration promotes. The cyclone effect in the filter pre-chamber is reinforced substantially by a tangential entry of the burner flame into the filter pre-chamber.

In another feature of the invention, embodying the filter after-chamber with double walls, in the form of a hollow frustoconical outflow cone for the burnoff gases, and introducing the secondary exhaust gas flow into the hollow wall of the outflow cone provide for simple heat recovery, which is especially advantageous if space considerations dictate a long connecting line between the separator and the disposal device, which can lead to considerable cooling of the secondary flow.

Further heat losses are avoided if the combustion chamber is provided with an insulating layer, at least in the vicinity of the filter and the filter prechamber, in accordance with another feature of the invention. A temperature stratification in the combustion chamber, which makes it unnecessary to provide such insulation of the combustion chamber, is attained by disposing the filter pre-chamber, filter chamber and filter after-chamber concentrically, in accordance with a further feature of the invention.

In another feature of the invention, if the combustion chamber outlet opening is connected to an exhaust gas line that discharges in the primary exhaust gas flow via a venturi tube exposed to the primary flow, the secondary exhaust gas flow will have a sufficient velocity for particle transport even if the filter is heavily loaded.

In an advantageous embodiment of the invention, the pilot burner is embodied as a swirl burner with tangential delivery of fuel and/or air. Swirl burners offer adequate flame stability over a wide range of engine operating conditions. The air is supplied via a magnetic valve from a compressed air reservoir or by an electric-motor-driven air pump, preferably a vane cell pump. The fuel metering is done with a clocked magnetic valve or a fuel feed pump. In the first case, a pressure limiting valve must be provided for damping the return flow of fuel to the tank. The fuel-air mixture is ignited by a glow plug.. The fuel continues to burn automatically, if the mixture is adequate. The oxygen for soot combustion is derived from the secondary exhaust gas flow and from the air excess in the mixture. This oxygen supply is relatively limited, so that even if the filter is heavily loaded, uncontrolled combustion cannot occur, which effectively eliminates the danger of overheating of the filter.

In a further feature of the invention, a PI regulator is provided, which regulates the delivered quantity of fuel and/or air as a function of the output signal of a temperature sensor that detects the temperature at the filter, so that an optimal temperature for combustion with minimum fuel consumption is attained. The burner may operate either continuously, with or without delayed starting, or discontinuously. The latter mode of operation is preferable, because with it, fuel consumption is particularly low.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
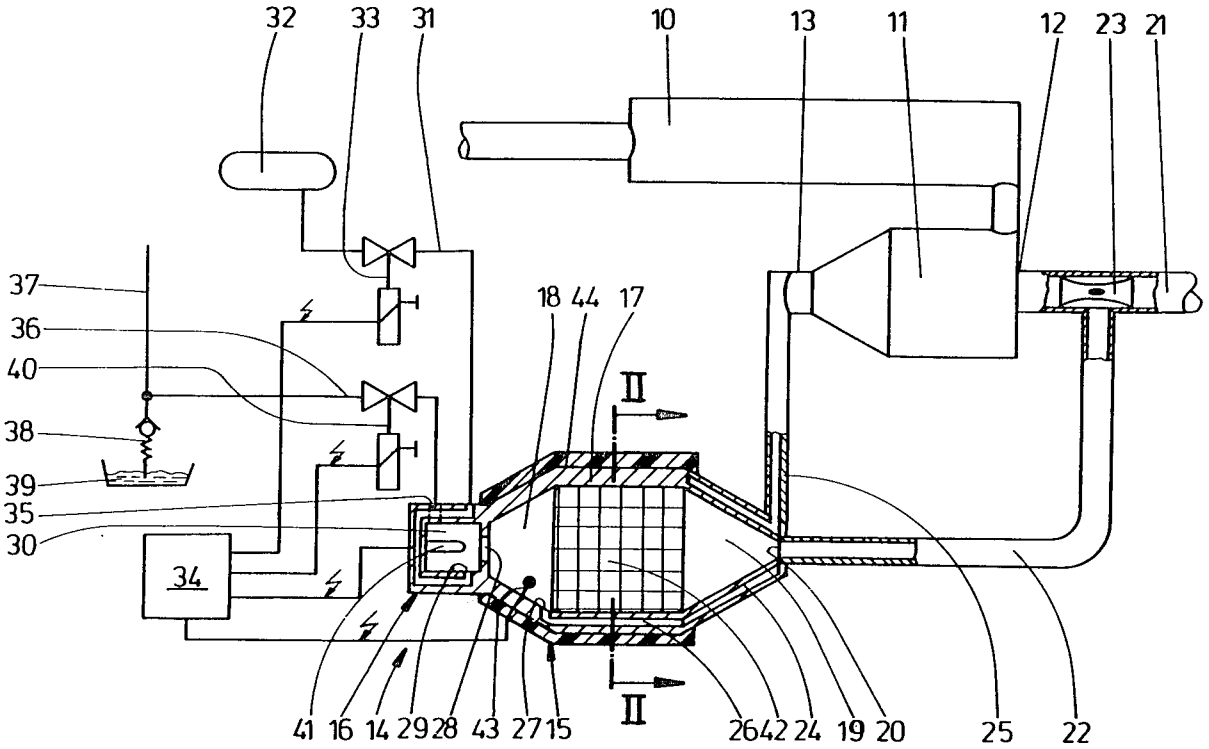
FIG. 1 schematically shows an apparatus for removing solid particles from the exhaust gas of an internal combustion engine.

The exhaust gas produced by an internal combustion engine, not shown, flows via an agglomerator 10, also known as an electrostatic soot shunt or electric filter tube, to a separator 11 in the form of a centrifugal filter, also called a cyclone. A largely particle-free primary flow of exhaust gas emerges from one outlet 12 of the separator 11; emerging from its other outlet 13 is a secondary flow of exhaust gas that is heavily laden with solid particles, especially soot particles, that have coagulated into clumps. The structure and operation of both the agglomerator 10 and the centrifugal filter 11 are described in German Offenlegungsschrift No. 34 24 196, for example. The outlet 12 communicates with a primary exhaust gas line 21 that leads to the engine exhaust gas system, while the other outlet 13 is connected to a disposal device 14.

The disposal device 14 includes a rotationally symmetrical combustion chamber 15 and a pilot burner 16 coaxially adjoining it. The combustion chamber 15 is divided into three chambers: a circular-cylindrical filter chamber 17, a filter pre-chamber 18 adjoining it on one side, and a filter after-chamber 19 adjoining it on the other. A filter 42 of an arbitrary material that has proven suitable for soot filtration is disposed in the filter chamber 17. Suitable materials include ceramic monoliths, expanded ceramics, ceramic coil filters and knitted wire filters. The pre-chamber 18 and the after-chamber 19 are both embodied as hollow truncated cones; the filter after-chamber 19 forms an outflow cone for the burnoff gases from the filter chamber 17, while the filter pre-chamber 18 forms an inflow cone for the entry of a fuel-air mixture to the filter chamber 17.

Figure 2:
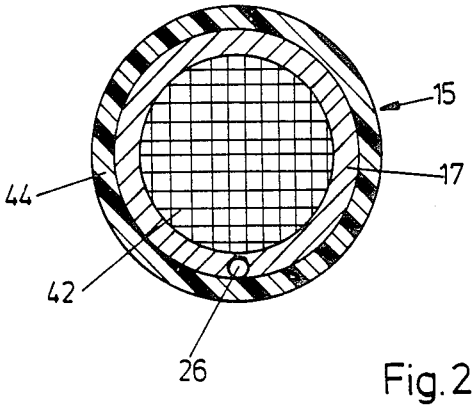
FIG. 2 is a section through a combustion chamber taken along the line II—II of FIG. 1.

The opening of the filter after-chamber 19 on the face end having the smaller cross section forms the outlet opening 20 for the burnoff gases, which communicates with the primary exhaust gas line 21 via a secondary exhaust gas line 22. Preferably, a venturi tube 23 is disposed at the mouth of the secondary exhaust gas line 22 in the primary exhaust gas line 21, to produce a certain suction pressure in the secondary exhaust gas line 22. The filter after-chamber 19 is double-walled, and the intervening hollow space 24 has an inlet fitting 25, which is connected to the outlet 13 of the centrifugal filter 11, discharging into the hollow space 24 at one side and an axial conduit 26 on the other (see also FIG. 2), which extends through the filter chamber 17, preferably extending in its wall, and with an inlet opening 27 enters the filter pre-chamber 18 at a tangent, near the filter chamber 17. By constructing the filter after-chamber 19 in this way, a heat exchanger is created, by which the particle-laden secondary exhaust gas flow arriving from the centrifugal filter 11 is heated, prior to entering the filter pre-chamber 18, by the hot burnoff gases flowing through the filter afterchamber 19.

In the filter pre-chamber 18, embodied as an inflow cone, the opening on the face end having the smaller cross section forms an overflow opening 28 between the pilot burner 16 and the combustion chamber 15, through which the combustible fuel-air mixture produced in the pilot burner 16 enters the filter pre-chamber 18 of the combustion chamber 15, where it is combusted along with the secondary exhaust gas flow. The pilot burner is embodied as a swirl burner, known per se, having fuel and/or air supplied at a tangent. The design and mode of operation of such a swirl burner are known, for instance from German Offenlegungsschrift No. 35 26 74. As schematically indicated in FIG. 1, air is supplied via an inflow opening 29 disposed near the overflow opening 28. The combustion air is at the same time used as coolant air for the pilot burner 16, to which end the wall of the burner chamber 30 is doublewalled, and the thus-formed hollow space communicates on the one hand with the tangential inflow opening 29 and on the other is connected to an air supply line 31, which leads to a compressed air reservoir 32. A magnetic valve 33 controlled by a regulating device 34 for metering the combustion air is disposed in the air supply line 31. Fuel is supplied via an inflow opening 35, again having a tangential inflow direction, which is connected to a fuel supply line 36. The fuel supply line 36 discharges into a fuel return 37 communicating via a pressure limiting valve 38 with a fuel tank 39. For metering the fuel, a magnetic valve 40 likewise controlled by the regulating device 34 is disposed in the fuel supply line 36. Instead of the compressed air reservoir 32 and the magnetic valve 33, an air pump, preferably a vane cell pump, may be used. Similarly, the magnetic valve 40 may be replaced with a fuel feed pump. In that case, the pressure limiting valve is unnecessary. The ON period of the vane cell pump and fuel feed pump would then likewise be controlled by the regulating device 34.

The fuel-air mixture metered by the regulating device 34 is ignited, when the disposal device 14 is turned on, by a glow plug 41 or a glow element having an additional ignition device. The flame burns through the overflow opening 28 into the filter pre-chamber 18 and on into the filter chamber 17, and forms an ignition zone downstream of the overflow opening 28. Combustible solid particles present in this ignition zone, which have either been deposited on the walls of the filter pre-chamber 18 because of their weight or have been trapped in the filter 42 are combusted. The gaseous products of combustion, along with the residual gases, leave the combustion chamber 15 via the outlet opening 20 in the filter after-chamber 19. After the ignition, the flame continues to burn, so that the electric heating of the sheathed-element glow plug 41 can be shut off again. A temperature sensor 43 disposed as a thermal element and disposed downstream of the burner near the filter 42, monitors the surface temperature of the filter 42. By the regulating device 34, which is preferably a PI regulator, and with the aid of the output signal of the temperature sensor 43, the fuel and air quantity are metered such that the temperature at the filter 42 maintains a set-point value. This set-point value is approximately 550° C. If the filter 42 is coated with a catalyst, this value can be reduced by approximately 200° C. To avoid heat losses, the combustion chamber 15 is provided with an insulating layer 44; it is sufficient for the insulating layer 44 to cover the vicinity of the filter pre-chamber 18 and the filter chamber 17.

The regulating device 34 is part of a control unit, which not only turns the sheathed-element glow plug 41 on and off but also shuts the pilot burner 16 on and off, by allowing or suppressing the supply of fuel. The following modes of operation of the pilot burner 16 are possible:

(a) Permanent operation: The pilot burner 16 is switched on immediately after the engine is started, and is shut off again when the engine is turned off. Engine starting and stopping can be detected by the control unit, via the engine rpm or the battery charge monitor.

(b) Continuous operation with delayed starting: The pilot burner 16 is switched on, with a delay after engine starting, and is shut off again when the engine is turned off. The delay may for instance be measured by the engine operating time calculated from the instant of starting, by the number of revolutions since engine starting, or by the quantity of fuel consumed since engine starting. The second case requires an rpm sensor, while the last case requires both an rpm sensor and an injection quantity sensor. If the time between two or more successive starts of the engine is less than the selected delay, then the next time the engine is started the delay is reduced. After the pilot burner 16 is switched on, it is kept in operation for at least long enough (10 minutes, for example) that the filter 42 is nearly fully regenerated. If the pilot burner is switched off early because the engine is turned off, then the next time the engine is started, the pilot burner 16 is switched on with no delay.

(c) Discontinuous operation (clocking): The pilot burner 16 is switched on after a delay, the delay being calculated from the previous time the pilot burner 16 was switched on. The pilot burner 16 is switched off independently of the engine, as soon as a burn duration sufficient for full regeneration of the filter 42 (for example, 10 minutes) has elapsed.

Figure 3:
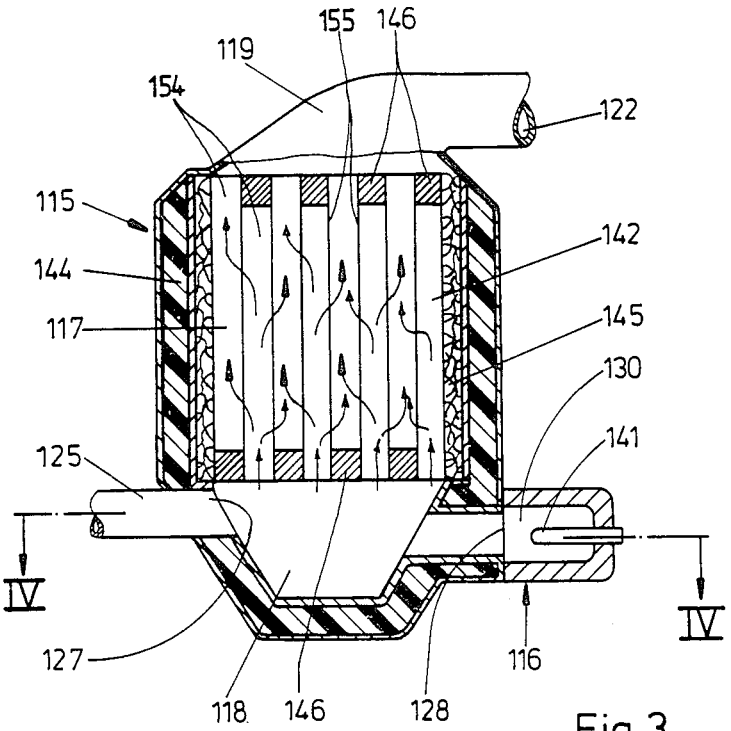
FIG. 3 is a schematic longitudinal section through a combustion chamber in the apparatus of FIG. 1, in a further exemplary embodiment.
Figure 4:
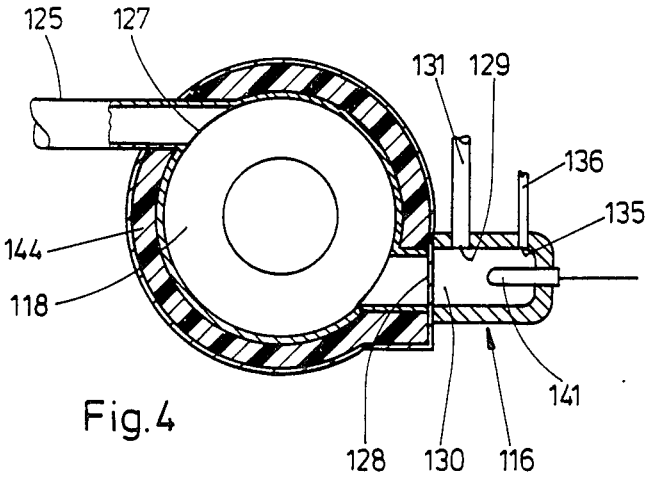
FIG. 4 is a section through the combustion chamber taken along the line IV—IV of FIG. 3.

FIGS. 3 and 4 show a modified combustion chamber 115, which can be used in the apparatus of FIG. 1 instead of the combustion chamber 15. When identical elements of the combustion chamber 115 are identical to those of the combustion chamber 15, they are identified by the same reference numerals, raised by 100.

In the installed position of the combustion chamber 115, the longitudinal axis of the combustion chamber 115 is approximately vertical, and the filter 142 disposed in the filter chamber 117 is embodied as a ceramic monolith through which the flow is in the axial direction and which thus is likewise oriented vertically. The ceramic monolith is held in the filter chamber 117 by a knitted wire cloth 145. The ceramic monolith comprises a great number of parallel vertical chutes 154, divided from one another by porous walls 155. Alternating chutes 154 are closed at opposite face ends by ceramic plugs 146, so that each chute 154 is open at one face end and closed at the other. If one chute 154 is closed at its end oriented toward the filter prechamber 118, then the chutes 154 immediately adjacent it on either side are closed on the end toward the filter after-chamber 119, and vice versa. The pilot burner 116 is flanged on transversely to the axis of the combustion chamber 115, and the overflow opening 128 between the burner chamber 130 and the filter pre-chamber 118 has an orifice axis extending at a tangent to the filter prechamber 118. In this way, the burner flame is delivered to the filter pre-chamber 118 at a tangent, which further reinforces the cyclone effect brought about by the tangential delivery of the secondary exhaust gas flow into the filter pre-chamber 118, so that larger solid particles already burn up in the filter pre-chamber 118 and do not reach the ceramic monolith, which operates as a deep-bed filter. The smaller and lighter solid particles flow vertically through the filter 142 and are retained in it. Incombustible solid particles like ash and rust are loosened by vehicle vibration and drop out of the filter 142, so the danger of filter plugging by incombustible solid particles is greatly reduced.

Figure 5:
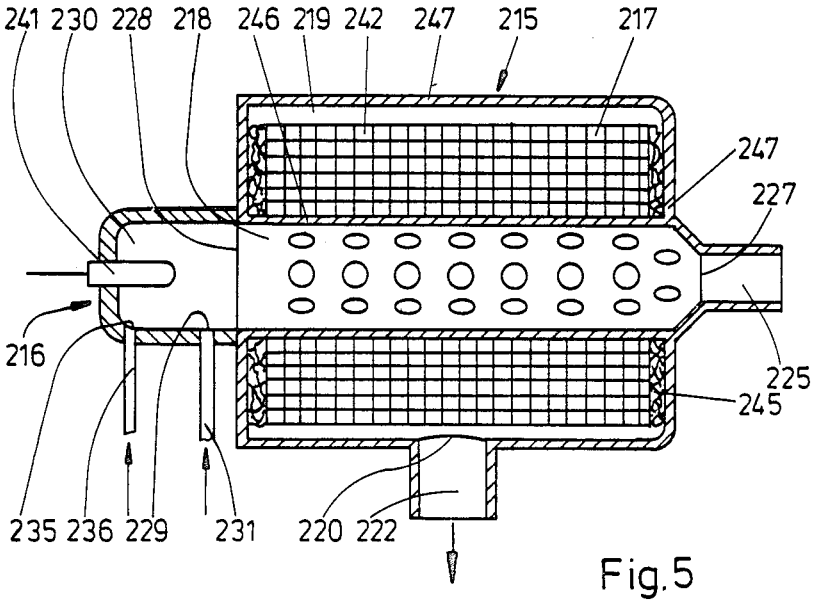
FIGS. 5 and 6 are schematic longitudinal sections through the combustion chamber of FIG. 1 in a third and fourth exemplary embodiment, respectively.

In the further embodiment of a combustion chamber 215 shown in longitudinal section in FIG. 5, the filter pre-chamber 218, filter chamber 217 and filter after-chamber 219 are disposed concentrically with one another. The filter pre-chamber is embodied as a perforated tube 246, which has the inlet opening 227 for the secondary exhaust gas flow on one face end and the overflow opening 228 to the pilot burner 216 on the other. Thus the secondary flow and the burner flame enter the filter pre-chamber 218 axially at opposed face ends and pass into the filter chamber 217 through the holes 248 of the tube 246.

The filter chamber 217 and the filter afterchamber 219 form a structural unit and are encompassed by a common housing cylinder 247, which is joined in a gas-tight manner to the tube 246. The inside of the filter chamber 217 is filled with a hollow-cylindrical filter 242, which is mounted directly on the tube 246 and through which the secondary exhaust gas flow and the exhaust gases of the pilot burner 16 flow radially. The filter is embodied as a deep-bed filter and may be made of expanded ceramic or as a coil filter. If ceramic material is used, it must be held in place at the face ends with knitted wire cloth 245. The filter 242 terminates at a radial distance from the inside jacket of the housing cylinder 247 and thus defines the filter afterchamber 219, which has an annular cross section and has the same axial length as the filter 242 and tube 246. The outlet opening 220 is disposed radially in the middle of the filter after-chamber 219 and connected to the secondary exhaust gas line 222. The pilot burner 216 has the same structure as that described in conjunction with FIG. 1. In this embodiment of the combustion chamber 215, the soot-laden secondary exhaust gas flow flows radially from the inside out through the filter 242. The exhaust gases of the pilot burner have the same flow direction. Because of the resultant temperature stratification, no additional insulation of the combustion chamber is needed.

Figure 6:
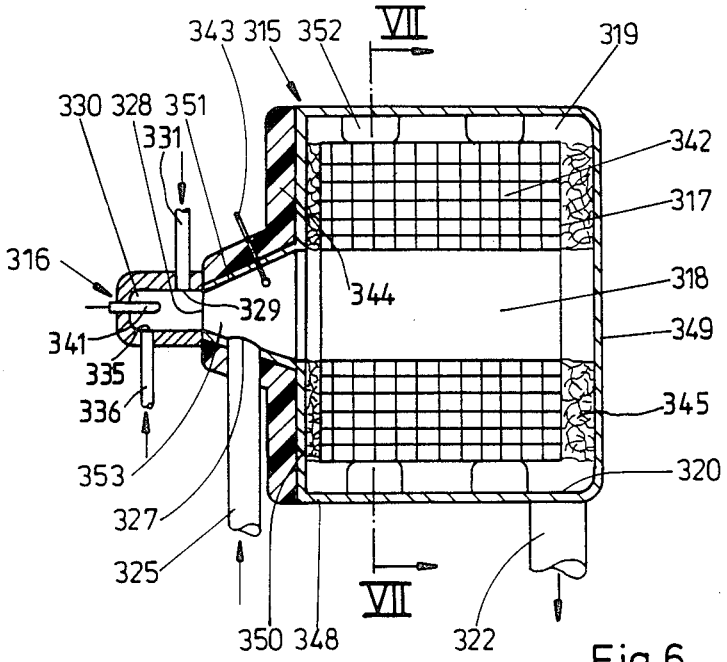
Figure 7:
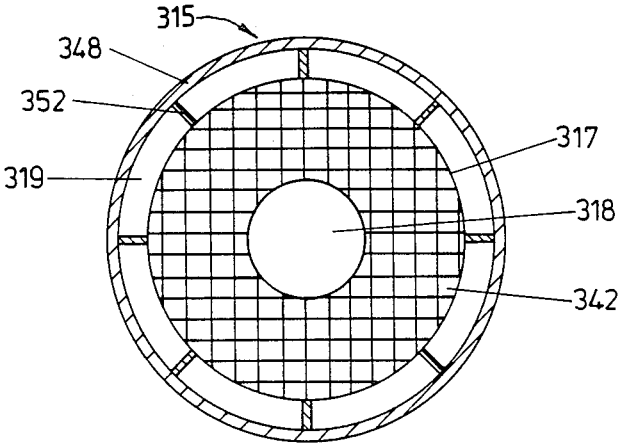
FIG. 7 is a section through the combustion chamber taken along the line VII—VII of FIG. 6.

The combustion chamber 315 shown schematically in longitudinal section and cross section in FIGS. 6 and 7, respectively, is similar in structure to the combustion chamber 215 of FIG. 5, in that once again, the filter pre-chamber 318, the filter chamber 317 and the filter after-chamber 319 are concentric with one another. The front portion of the filter pre-chamber 318 is embodied as an inflow cone 353, the opening of which on the face end having the smaller cross section forms the overflow opening 328 to the pilot burner 316. The filter chamber 317, filter pre-chamber 318 and filter after-chamber 319 are encompassed by a common circular-cylindrical housing cut 348, which on its face end opposite the cup shaped bottom 349 merges integrally, via a radial shoulder 350, with a central conical cup shaped fitting 351, which surrounds the inflow cone 353. In the vicinity of the radial shoulder 350 and cup shaped fitting 351, the outer wall of the housing cup 348 is coated with an insulating layer 344. The hollow-cylindrical filter 342 is disposed coaxially in the interior of the housing cup 348, being retained at its ends on the cup shaped bottom 349 and on the radial shoulder 350 and also resting with its outer circumference on ribs 352 protruding radially inward from the inside jacket of the housing cup shape 348. In filters of ceramic material, for the sake of axial bracing, it is necessary to provide knitted wire cloths 245 at the face ends, between the filter and the cup shaped bottom 349 and between the filter and the radial shoulders 350. These ribs 352 define the radial width of the filter after-chamber 319. The outlet opening 320 for the burnoff gases is located adjacent the up shaped bottom 349, on the end of the filter after-chamber 319 remote from the inflow cone 353 of the filter pre-chamber. The axis of the outlet opening 320 is oriented radially. The pilot burner 316, mounted axially on the cup fitting 351, is identical to those described above. Identical elements are therefore provided with the same reference numerals, raised by 300.

The soot-laden secondary flow of exhaust gas, entering the inflow cone 353 of the filter pre-chamber 318 at a tangent via the inlet fitting 325 and the inlet opening 327, is swirled out of the pilot chamber 316 together with the axially inflowing, ignited fuel-air mixture, and the combustible solid particles are combusted. The burnoff gases pass radially through the filter 342 and reach the filter after-chamber 319, which is annular in cross section, on the circumference of the filter 342. From there, they exit via the outlet opening 320 into the secondary exhaust gas line 322 and are delivered to the engine exhaust system. The required surface temperature of the filter 342 required for optimal combustion of the soot can be reduced by 200° C., from approximately 550° C., by coating the filter 342 with a catalyst.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus device for removing solid particles, especially soot particles, from an exhaust gas flow of an internal combustion engine, in particular a Diesel engine, having a separator for dividing the flow of exhaust gas into a largely particle-free primary flow and a particle-enriched secondary flow, said separator including a first outlet for said particle-enriched secondary flow and a second outlet for said largely particle-free primary flow, a particle disposal device, said particle disposal device including a combustion chamber, said combustion chamber including an inlet opening connected to said first outlet for the secondary flow of exhaust gas, a pilot burner (16) connected to said combustion chamber for producing a burnoff flame that burns off any solid particles in said combustion chamber, said particle disposal device including an outlet opening for removing any gaseous product of said burnoff flame, a filter (42; 142; 242; 342) disposed in said combustion chamber (15; 115; 215; 315) between said inlet opening and said outlet opening, said filter divides said combustion chamber (15; 115; 215; 315) into a filter pre-chamber (18; 118; 218; 218) and a filter after-chamber (19; 119; 219; 319), wherein said burnoff flame burns in said filter pre-chamber (18; 118; 218; 318), and the outlet opening (20; 120; 220; 320) joins said filter after-chamber (19; 119; 219; 319).

2. An apparatus as defined by claim 1, in which said inlet opening (27; 127; 327) is disposed with a tangential inflow direction in said the filter pre-chamber (18; 118; 318) near the filter (42; 142; 342).

3. An apparatus as defined by claim 1, in which said combustion chamber includes a hollow-cylindrical filter chamber, said filter (42; 142; 242; 342) is embodied as a deep-bed filter which is disposed in said hollow-cylindrical filter chamber (17; 117; 217; 317) between a filter pre-chamber (18; 118; 218; 318) and a filter after chamber (19; 119; 219; 319).

4. An apparatus as defined by claim 2, in which said combustion chamber includes a hollow-cylindrical filter chamber, said filter (42; 142; 242; 342) is embodied as a deep-bed filter which is disposed in said hollow-cylindrical filter chamber (17; 117; 217; 317) between a filter pre-chamber (18; 118; 218; 318) and a filter after chamber (19; 119; 219; 319).

5. An apparatus as defined by claim 3, in which said filter (142) is embodied as a ceramic monolith having an axial flow direction therethrough, said filter is retained in a vertical orientation in said filter chamber (117) by means of a knitted wire cloth (145), and that said pilot burner (116) communicates with the combustion chamber (115) via an overflow opening (128) having an inflow direction at a tangent to the combustion chamber (115).

6. An apparatus as defined by claim 4, in which said filter (142) is embodied as a ceramic monolith having an axial flow direction therethrough, said filter is retained in a vertical orientation in said filter chamber (117) by means of a knitted wire cloth (145), and that said pilot burner (116) communicates with the combustion chamber (115) via an overflow opening (128) having an inflow direction at a tangent to the combustion chamber (115).

7. An apparatus as defined by claim 1, in which said filter after-chamber (19) includes double walls and includes a hollow frustoconical outflow cone for the burnoff gases, an opening of said outflow cone oriented toward said filter (42) has a large cross section through which said exhaust gases flow is in an axial direction and an opening of said outflow cone at the face end has a smaller cross section and forms said outlet opening (20), and that at the end of the outflow cone having the outlet opening (20), an inlet fitting (25) communicates with said first outlet (13) for the secondary exhaust gas flow of said separator (10, 11) which discharges approximately radially into a hollow space (24) of said outflow cone located between said double walls, said hollow space (24) discharges axially at the end of the outflow cone oriented toward the filter (42) into an overflow conduit (26) having an opening (27) located on its other end of this overflow conduit (26) which discharges into said filter prechamber.

8. An apparatus as defined by claim 2, in which said filter after-chamber (19) includes double walls and includes a hollow frustoconical outflow cone for the burnoff gases, an opening of said outflow cone oriented toward said filter (42) has a large cross section through which said exhaust gases flow is in an axial direction, and an opening of said outflow cone at the face end has a smaller cross section and forms said outlet opening (20), and that at the end of the outflow cone having the outlet opening (20), an inlet fitting (25) communicates with said first outlet (13) for the secondary exhaust gas flow of said separator (10, 11) which discharges approximately radially into a hollow space (24) of said outflow cone located between said double walls, said hollow space (24) discharges axially at the end of the outflow cone oriented toward the filter (42) into an overflow conduit (26) having an opening (27) located on its other end of this overflow conduit (26) which discharges into said filter prechamber.

9. An apparatus as defined by claim 3, in which said filter after-chamber (19) includes double walls and includes a hollow frustoconical outflow cone for the burnoff gases, an opening of said outflow cone oriented toward said filter (42) has a large cross section through which said exhaust gases flow is in an axial direction, and an opening of said outflow cone at the face end has a smaller cross section and forms said outlet opening (20), and that at the end of the outflow cone having the outlet opening (20), an inlet fitting (25) communicates with said first outlet (13) for the secondary exhaust gas flow of said separator (10, 11) which discharges approximately radially into a hollow space (24) of said outflow cone located between said double walls, said hollow space (24) discharges axially at the end of the outflow cone oriented toward the filter (42) into an overflow conduit (26) having an opening (27) located on its other end of this overflow conduit (26) which discharges into said filter prechamber.

10. An apparatus as defined by claim 4, in which said filter after-chamber (19) includes double walls and includes a hollow frustoconical outflow cone for the burnoff gases, an opening of said outflow cone oriented toward said filter (42) has a large cross section through which said exhaust gases flow is in an axial direction, and an opening of said outflow cone at the face end has a smaller cross section and forms said outlet opening (20), and that at the end of the outflow cone having the outlet opening (20), an inlet fitting (25) communicates with said first outlet (13) for the secondary exhaust gas flow of said separator (10, 11) which discharges approximately radially into a hollow space (24) of said outflow cone located between said double walls, said hollow space (24) discharges axially at the end of the outflow cone oriented toward the filter (42) into an overflow conduit (26) having an opening (27) located on its other end of this overflow conduit (26) which discharges into said filter prechamber.

11. An apparatus as defined by claim 7, in which said filter pre-chamber (18) is embodied in the form of a hollow frustoconical inflow cone, an opening of said inflow cone oriented toward the filter (42) has a large cross section and an opening on the face end has a smaller cross section which forms an overflow opening (28) from said pilot burner (16) to the combustion chamber (15).

12. An apparatus as defined by claim 7, in which said filter (42) is embodied from a ceramic monolith, expanded ceramic or a ceramic coil through which the flow direction is axial.

13. An apparatus as defined by claim 11, in which said filter (42) is embodied from a ceramic monolith, expanded ceramic or a ceramic coil through which the flow direction is axial.

14. An apparatus as defined by claim 1, in which said filter pre-chamber (218), the filter chamber (217) and the filter after-chamber (219) formed by a cylinder wall (247) are embodied as hollow-cylindrical with closed face ends and disposed concentrically with one another with diameters increasing in the order given, a perforated partition (246) between the filter pre-chamber (218) and filter chamber (217), said inlet opening (227) for the secondary exhaust gas flow is located on one face end of said filter pre-chamber while an overflow opening (228) connecting the pilot burner (216) with the combustion chamber (215) is located on the opposite face end of said filter pre-chamber (218), a filter (242) in said filter chamber has a radial flow direction through it, and that said outlet opening (220) for the burnoff gases is disposed approximately centrally in the cylinder wall (247) of said filter after-chamber (219).

15. An apparatus as defined by claim 14, in which said filter (242) is embodied as expanded ceramic or a ceramic coil and is mounted directly on said partition (246) and is secured at a face end to the end walls of the filter chamber (217) by means of a knitted wire cloth (245).

16. An apparatus as defined by claim 1, in which said filter pre-chamber (318), said filter chamber (317) and said filter after-chamber (319) formed by a cylinder wall (347) are disposed concentrically to one another, said the filter pre-chamber (318) is coaxially preceded by a hollow frustoconical inflow cone (353), said inflow cone includes a small cross section opening which forms an overflow opening (328) from said pilot burner (316) to said combustion chamber (315), said filter pre-chamber (318), said filter chamber (317) and said filter after-chamber (319) are encompassed by a cup shaped housing (348), which on its face end remote from its cup shaped bottom (349) merges integrally via a radial shoulder (350) with a conical cup shaped fitting (351) which surrounds an inflow cone (353), an inner wall of said cup shaped fitting having radially protruding axial ribs (352), on which rests a hollow-cylindrical filter (342) has a radial flow direction through it and made preferably of expanded ceramic or embodied as a ceramic coil and said outlet opening (320) for the burnoff gases is disposed in said cylinder wall of the cup shaped housing (348) near said cup shaped bottom (349).

17. An apparatus as defined by claim 1, in which said combustion chamber (15; 115; 315) is encompassed, at least partially, with an insulating layer (44; 144; 344).

18. An apparatus as defined by claim 1, in which a primary exhaust gas line (21) connects with said second outlet for said largely particle-free primary flow, said primary exhaust gas line includes a venturi tube (23) therein a second exhaust gas line (22) connected to said outlet opening (20) for the burnoff gases and to said primary exhaust gas line (23) which discharges in the primary exhaust gas flow via said venturi tube (23) acted upon by the primary flow from said particle disposal device.

19. An apparatus as defined by claim 1, in which the filter (42; 142; 242; 342) is provided with a catalytic coating.

20. An apparatus as defined by claim 1, in which said pilot burner (16; 116; 216; 316) is embodied as a swirl burner with a tangential delivery of fuel and/or air.

21. An apparatus as defined by claim 20, which includes a temperature sensor (43; 343) which detects a temperature at said filter (42; 342) and a regulating device (34) which regulates the quantity of fuel and/or air delivered to the swirl burner (16) as a function of an output signal of the temperature sensor (43; 343).

22. An apparatus as defined by claim 1, in which said pilot burner (16) is operated in continuous operation, in which said pilot burner is switched on, with or without a delay, when the engine is started and is shut off again when the engine is shut off.

23. An apparatus as defined by claim 1, in which said pilot burner (16) is operated periodically in which regardless of the engine operation the burn duration of the pilot burner is dimensioned such that adequate regeneration of the filter (42) by the burnoff of soot is assured.

* * * * *